US011851846B2

(12) United States Patent
Takeo et al.

(10) Patent No.: US 11,851,846 B2
(45) Date of Patent: Dec. 26, 2023

(54) EXCAVATOR

(71) Applicant: SUMITOMO CONSTRUCTION MACHINERY CO., LTD., Tokyo (JP)

(72) Inventors: Jitsutaka Takeo, Chiba (JP); Manabu Ito, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 176 days.

(21) Appl. No.: 17/448,972

(22) Filed: Sep. 27, 2021

(65) Prior Publication Data

US 2022/0010527 A1 Jan. 13, 2022

Related U.S. Application Data

(63) Continuation of application No. PCT/JP2020/011969, filed on Mar. 18, 2020.

(30) Foreign Application Priority Data

Mar. 29, 2019 (JP) ..... 2019-069009

(51) Int. Cl.
*E02F 9/20* (2006.01)
*E02F 9/22* (2006.01)

(52) U.S. Cl.
CPC ..... *E02F 9/2041* (2013.01); *E02F 9/207* (2013.01); *E02F 9/2029* (2013.01); *E02F 9/2079* (2013.01); *E02F 9/22* (2013.01)

(58) Field of Classification Search
CPC ..... E02F 9/2091; E02F 9/2029; E02F 9/2041; E02F 9/205
See application file for complete search history.

(56) References Cited

U.S. PATENT DOCUMENTS 3,875,747 A * 4/1975 Briggs ..... F15B 11/16 60/422
8,607,558 B2 12/2013 Kawaguchi et al.
(Continued)

FOREIGN PATENT DOCUMENTS

EP 2757782 7/2014
JP H09-158255 6/1997
(Continued)

OTHER PUBLICATIONS

International Search Report for PCT/JP2020/011969 dated Jun. 2, 2020.

*Primary Examiner* — Abiy Teka
(74) *Attorney, Agent, or Firm* — IPUSA, PLLC

(57) ABSTRACT

An excavator including a lower traveling body; an upper turning body turnably mounted to the lower traveling body; a work attachment attached to the upper turning body; an imaging device mounted to the upper turning body; a hydraulic actuator; a hydraulic pump configured to supply hydraulic oil to the hydraulic actuator; an electric motor configured to drive the hydraulic pump; an operation device of an electric type configured to operate the hydraulic actuator; and a control device configured to control the electric motor, wherein in response to determining that the operation device is not operated, the control device causes the hydraulic pump to automatically stop, and subsequently, in response to determining that an operation with respect to the operation device is started, the control device causes the hydraulic pump to be automatically activated.

20 Claims, 7 Drawing Sheets

(56) References Cited

U.S. PATENT DOCUMENTS

| | | | | |
|---|---|---|---|---|
| 9,523,295 | B2 | 12/2016 | Kawada et al. | |
| 2019/0249397 | A1 * | 8/2019 | Mizuno | E02F 9/26 |

FOREIGN PATENT DOCUMENTS

| | | | | |
|---|---|---|---|---|
| JP | 2010065445 | A * | 3/2010 | |
| JP | 2011-208568 | | 10/2011 | |
| JP | 2012-021362 | | 2/2012 | |
| JP | 2013-064320 | | 4/2013 | |
| JP | 2014-173258 | | 9/2014 | |
| JP | 2015-059519 | | 3/2015 | |
| JP | 2018-030396 | | 3/2018 | |
| WO | WO-2015005514 | A1 * | 1/2015 | E02F 9/2012 |
| WO | 2019/039522 | | 2/2019 | |

* cited by examiner

EXCAVATOR

CROSS-REFERENCE TO RELATED APPLICATIONS

The present application is a continuation application of International Application No. PCT/JP2020/011969 filed on Mar. 18, 2020, which claims priority to Japanese Patent Application No. 2019-069009, filed on Mar. 29, 2019. The contents of these applications are incorporated herein by reference in their entirety.

BACKGROUND

1. Technical Field

The present disclosure relates to an excavator.

2. Description of the Related Art

Conventionally, a technique is known in which a hydraulic pump for supplying hydraulic oil to a hydraulic actuator is stopped, when the hydraulic actuator of an excavator is not operated.

With such a technique, the energy consumption of the excavator can be reduced.

SUMMARY

According to an embodiment of the present invention, there is provided an excavator including a lower traveling body; an upper turning body turnably mounted to the lower traveling body; a work attachment attached to the upper turning body; an imaging device mounted to the upper turning body; a hydraulic actuator; a hydraulic pump configured to supply hydraulic oil to the hydraulic actuator; an electric motor configured to drive the hydraulic pump; an operation device of an electric type configured to operate the hydraulic actuator; and a control device configured to control the electric motor, wherein in response to determining that the operation device is not operated, the control device causes the hydraulic pump to automatically stop, and subsequently, in response to determining that an operation with respect to the operation device is started, the control device causes the hydraulic pump to be automatically activated.

DETAILED DESCRIPTION

In the conventional technology, it is desirable that the energy consumption of the excavator is further reduced.

Therefore, it is desirable to provide a technique that can further reduce energy consumption in an excavator.

Hereinafter, embodiments will be described with reference to the drawings.

[Overview of Excavator]

First, an overview of an excavator as an example of a working machine will be described with reference to FIG. 1.

Figure 1:
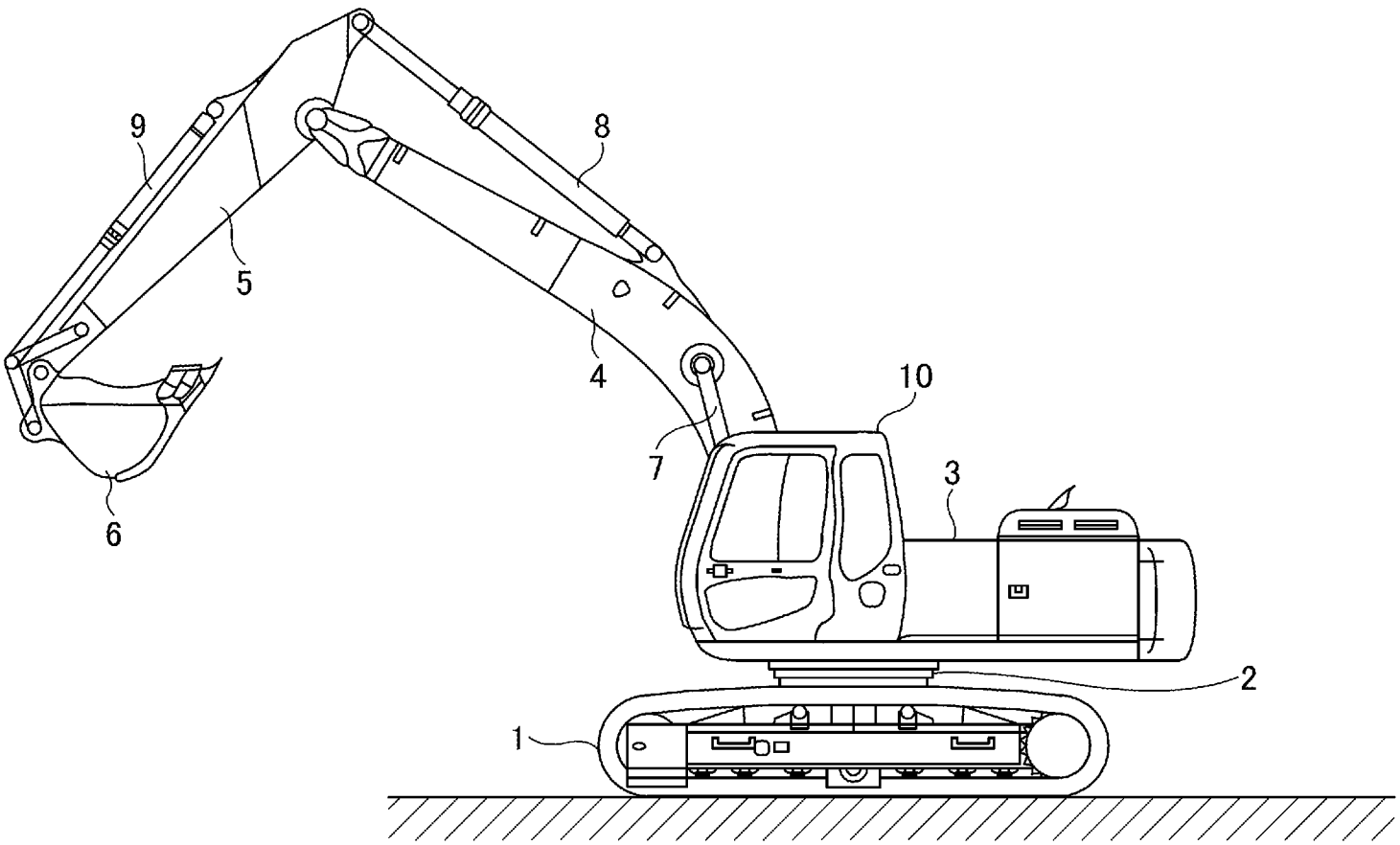
FIG. 1 is a side view of an excavator.

FIG. 1 is a side view illustrating an example of an excavator according to the present embodiment.

The excavator according to the present embodiment includes a lower traveling body 1, an upper turning body 3 which is mounted to the lower traveling body 1 in a turnable manner through a turning mechanism 2, a boom 4, an arm 5, and a bucket 6 as work devices, and a cabin 10 in which an operator is seated.

The lower traveling body 1 includes, for example, a pair of crawlers on the left and right, and each crawler is hydraulically driven by traveling hydraulic motors 1A and 1B (see FIG. 2), so as to be self-propelling.

The upper turning body 3 is electrically driven by a turning motor 21 (see FIG. 2) which will be described later through the turning mechanism 2, so that the upper turning body 3 turns relative to the lower traveling body 1. The upper turning body 3 may be hydraulically driven by a turning hydraulic motor instead of the turning motor 21 through the turning mechanism 2. In this case, the excavator according to the present embodiment corresponds to a configuration in which all of the driven elements are hydraulically driven by the hydraulic oil supplied from a main pump 14 (see FIG. 2) which is powered by an engine, and the power source (engine) of the hydraulic excavator is replaced by a pump motor 12.

The boom 4 is pivotally mounted to the front center of the upper turning body 3 so as to be elevated, the arm 5 is pivotally mounted to the leading end of the boom 4 so as to turn upward and downward, and the bucket 6 is pivotally mounted to the leading end of the arm 5 so as to turn upward and downward. The boom 4, the arm 5, and the bucket 6 are hydraulically driven by a boom cylinder 7, an arm cylinder 8, and a bucket cylinder 9, respectively, as hydraulic actuators.

The bucket 6 is an example of an end attachment, and other end attachments may be attached to the end of the arm 5 instead of the bucket 6, according to the work content and the like. Other end attachments may be, for example, buckets of a different type from the bucket 6, such as a slope bucket, dredging bucket, and the like. Other end attachments may also be, for example, end attachments of a different type from the bucket such as a breaker, an agitator, a grapple, or the like.

The cabin 10 is mounted on the front left side of the upper turning body 3, and an operator seat on which an operator is to be seated and an operation device 26, which will be described later, are provided inside (in the interior of) the cabin.

The excavator operates driven elements such as the lower traveling body 1 (left and right crawlers), the upper turning body 3, the boom 4, the arm 5, and the bucket 6, according to the operation of the operator seated in the cabin 10.

Further, instead of or in addition to being configured to be operable by an operator seated in the cabin 10, the excavator may be configured to be remotely operated from outside the excavator. When the excavator is remotely operated, the interior of the cabin 10 may be unmanned. The following discussion assumes that an operation by an operator includes at least one of an operation with respect to the operation device 26 by an operator in the cabin 10, or a remote operation by an external operator.

A remote operation includes a mode in which, for example, the excavator is operated by an operation input, which relates to an actuator of the excavator, performed by a predetermined external device. In this case, for example, the excavator transmits image information (a captured image), which is output by the imaging device that captures images of the area surrounding the upper turning body 3, to the external device, and the image information may be displayed on a display device (hereinafter, a "remote operation display device") provided in the external device. Various kinds of information images (information screens) displayed on the display device 50, which will be described later, in the interior of the cabin 10 of the excavator, may also be displayed on the remote operation display device of the external device. Accordingly, the operator of the external device can remotely operate the excavator while confirming the display contents, such as a captured image representing the appearance of the surroundings of the excavator or an information screen and the like displayed on the remote operation display device. The excavator may then operate the actuator according to a remote operation signal representing the content of the remote operation received from the external device and drive the driven elements such as the lower traveling body 1 (left and right crawlers), the upper turning body 3, the boom 4, the arm 5, and the bucket 6.

The remote operation may also include a mode in which the excavator is operated, for example, by voice sound input or gesture input to the excavator from outside, by a person (e.g., a worker) around the excavator. Specifically, the excavator recognizes the speech spoken by a surrounding worker or a gesture carried out by the worker, etc., through a voice sound input device (e.g., a microphone) or a gesture input device (e.g., an imaging device) mounted on the excavator. The excavator may operate the actuator according to the content of the recognized voice sound, gesture, or the like, and drive the driven elements such as the lower traveling body 1 (the right and left crawlers), the upper turning body 3, the boom 4, the arm 5, and the bucket 6.

The excavator may also automatically operate the hydraulic actuator regardless of the content of the operator's operation. Thus, the excavator implements a function (hereinafter, an "automatic operation function" or a "machine control function") to automatically operate at least some of the driven elements such as the lower traveling body 1 (left and right crawlers), the upper turning body 3, the boom 4, the arm 5, and the bucket 6.

The automatic operation function may include a function (so-called "semi-automatic operation function") to automatically operate a driven element (hydraulic actuator) other than the driven element (hydraulic actuator) to be operated, according to the operator's operation on the operation device 26 or remote operation. Further, the automatic operation function may include a function to automatically operate at least some of a plurality of driven elements (hydraulic actuators) without the operator's operation on the operation device 26 or remote operation (so-called "fully automatic operation function"). In the excavator, the interior of the cabin 10 may be unmanned if a fully automatic operation function is enabled. Further, the semi-automatic operation function, the fully automatic operation function, and the like may include a mode in which the motion content of the driven element (hydraulic actuator) subject to automatic operation is determined automatically according to predefined rules. Further, the semi-automatic operation function, the fully automatic operation function, and the like may include a mode in which the excavator autonomously makes various determinations, and then determines, based on the determination result, the motion content of a driven element (hydraulic actuator) subject to autonomous operation (so-called "autonomous operation function").

[Configuration of Excavator]

Next, the configuration of the excavator according to the present embodiment will be described with reference to FIG. 2 in addition to FIG. 1.

Figure 2:
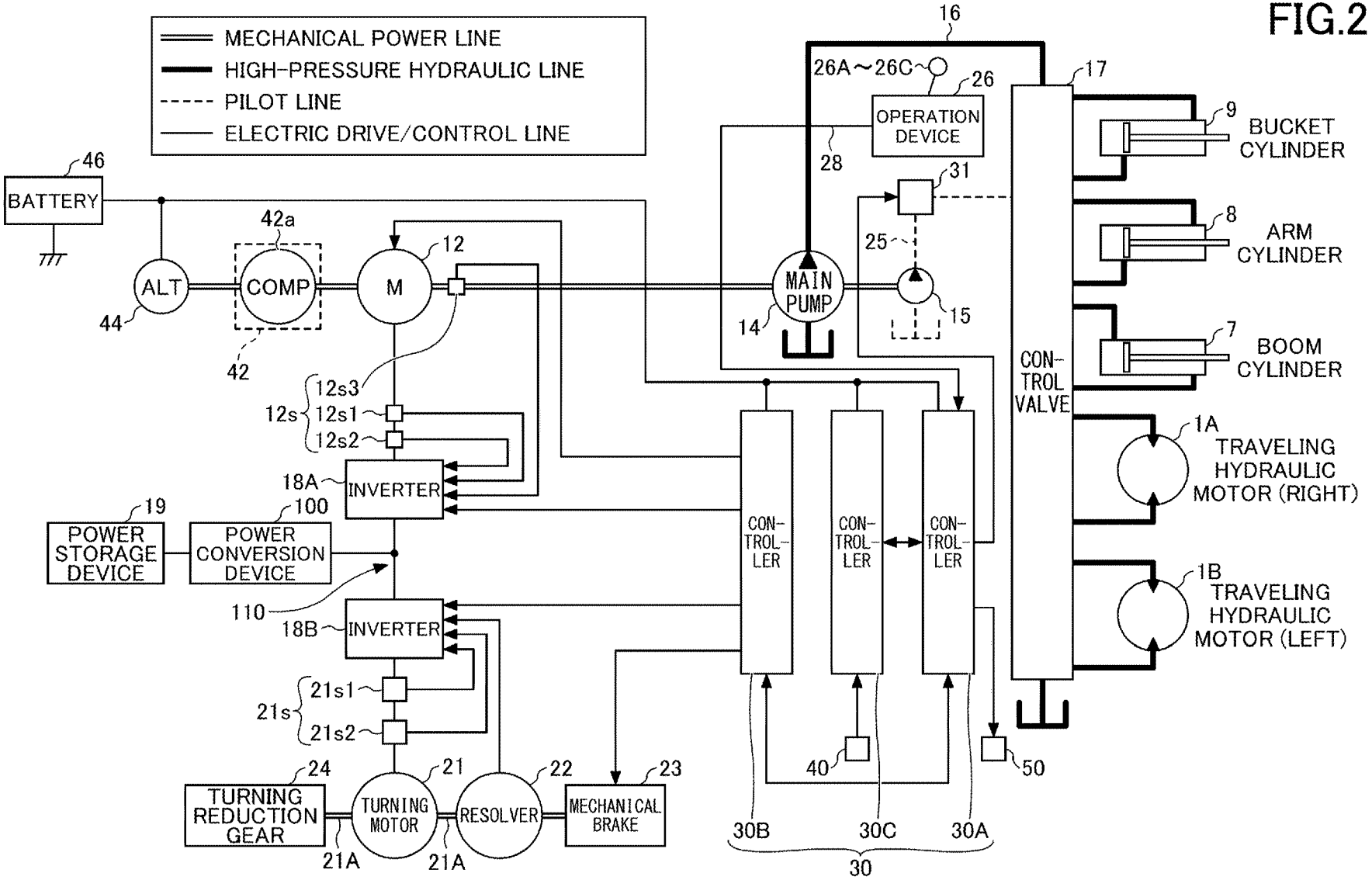
FIG. 2 is a block diagram schematically illustrating an example of a configuration of an excavator.

FIG. 2 is a block diagram illustrating an example of a configuration centering around a driving system of the excavator according to the present embodiment.

In the figure, the mechanical power line is illustrated by a double line, the high-pressure hydraulic line is illustrated by a thick solid line, the pilot line is illustrated by a dashed line, and the electric drive/control line is illustrated by a thin solid line.

<Hydraulic Driving System>

The hydraulic driving system of the excavator according to the present embodiment includes hydraulic actuators such as the traveling hydraulic motors 1A and 1B, the boom cylinder 7, the arm cylinder 8, and the bucket cylinder 9 for hydraulically driving each driven element such as the lower traveling body 1, the boom 4, the arm 5, and the bucket 6. The hydraulic driving system of the excavator according to the present embodiment includes the pump motor 12, a main pump 14, and a control valve 17.

The pump motor 12 (an example of an electric motor) is a power source for the hydraulic driving system. The pump motor 12 is, for example, an IPM (Interior Permanent Magnet) motor. The pump motor 12 is connected to a power storage system including a power storage device 19 and a power conversion device 100 and to the turning motor 21, via an inverter 18A. The pump motor 12 performs a power running operation by three-phase AC power supplied from the power storage device 19 and the turning motor 21 via the inverter 18A to drive the main pump 14 and a pilot pump 15. The drive control of the pump motor 12 may be implemented by the inverter 18A under the control of a controller 30B, which will be described later.

The main pump 14 (an example of a hydraulic pump) supplies hydraulic oil to the control valve 17 through a high pressure hydraulic line 16. The main pump 14 is driven by the pump motor 12. The main pump 14 is, for example, a variable displacement hydraulic pump and a regulator (not illustrated) controls the angle (tilt angle) of the swash plate under the control of the controller 30A, which will be described later. Accordingly, the main pump 14 can adjust the stroke length of the piston and control the discharge flow rate (discharge pressure).

The control valve 17 is a hydraulic control device which controls the hydraulic driving system according to operations relating to a driven element (a corresponding hydraulic actuator) by an operator and operation instructions relating to a driven element (a corresponding hydraulic actuator) corresponding to the automatic operation function. As described above, the control valve 17 is connected to the main pump 14 via the high pressure hydraulic line 16 and is configured to selectively supply hydraulic oil supplied from the main pump 14 to hydraulic actuators (the traveling hydraulic motors 1A and 1B, the boom cylinder 7, the arm cylinder 8, and the bucket cylinder 9). For example, the control valve 17 is a valve unit which includes a plurality of hydraulic control valves (directional changeover valves) for controlling the flow rate and flow direction of hydraulic oil supplied from the main pump 14 to each of the hydraulic actuators.

<Electric Driving System>

The electric driving system of the excavator according to the present embodiment includes the pump motor 12, a sensor 12*s*, and the inverter 18A. The electric driving system of the excavator according to the present embodiment also includes the turning motor 21, a sensor 21*s*, a resolver 22, a mechanical brake 23, a turning reduction gear 24, and an inverter 18B.

The sensor 12*s* includes a current sensor 12*s*1, a voltage sensor 12*s*2, and a rotation state sensor 12*s*3.

The current sensor 12*s*1 detects the current of each of the three phases (U phase, V phase, and W phase) of the pump motor 12. The current sensor 12*s*1 is provided, for example, in a power path between the pump motor 12 and the inverter 18A. The detection signal corresponding to the current of each of the three phases of the pump motor 12 detected by the current sensor 12*s*1 is directly entered into the inverter 18A through a communication line. Alternatively, the detection signal may be entered into the controller 30B through a communication line and input to the inverter 18A through the controller 30B.

The voltage sensor 12*s*2 detects the applied voltage of each of the three phases of the pump motor 12. A voltage sensor 12*s*2 is provided, for example, in the power path between the pump motor 12 and the inverter 18A. The detection signal corresponding to the applied voltage of each of the three phases of the pump motor 12 detected by the voltage sensor 12*s*2 is directly entered into the inverter 18A through a communication line. Alternatively, the detection signal may be entered into the controller 30B through a communication line and be input to the inverter 18A through the controller 30B.

The rotation state sensor 12*s*3 detects the rotation state (for example, rotation position (rotation angle), rotation speed, etc.) of the pump motor 12. The rotation state sensor 12*s*3 is, for example, a rotary encoder or a resolver.

The inverter 18A drives and controls the pump motor 12 under the control of the controller 30B. The inverter 18A includes, for example, a conversion circuit that converts DC power to three-phase AC power or converts three-phase AC power to DC power, a driving circuit that drives and switches the conversion circuit, and a control circuit that outputs a control signal (e.g., a PWM (Pulse Width Modulation) signal) that defines the operation of the driving circuit.

The control circuit of the inverter 18A performs drive control of the pump motor 12 while identifying the operation state of the pump motor 12. For example, the control circuit of the inverter 18A identifies the operation state of the pump motor 12 based on the detection signal of the rotation state sensor 12*s*3. The control circuit of the inverter 18A may identify the operation state of the pump motor 12 by sequentially estimating the rotation angle of the rotational shaft of the pump motor 12 or the like based on the detection signal of the current sensor 12*s*1 and the detection signal of the voltage sensor 12*s*2 (or the voltage instruction value generated in the control process).

Note that at least one of the driving circuit and the control circuit of the inverter 18A may be provided external to the inverter 18A.

Under the control of the controller 30B and the inverter 18B, the turning motor 21 performs a power running operation to drive the turning of the upper turning body 3, and a regenerative operation to generate regenerative power to turn and brake the upper turning body 3. The turning motor 21 is connected to the power storage system (i.e., the power storage device 19 and the power conversion device 100) via the inverter 18B and is driven by three-phase AC power supplied from the power storage device 19 via the inverter 18B. The turning motor 21 supplies regenerative power to the power storage device 19 or the pump motor 12 through the inverter 18B. Accordingly, the power storage device 19 can be charged or the pump motor 12 can be driven by regenerative power. Control for switching between the power running operation and the regenerative operation of the turning motor 21 may be implemented by the inverter 18B under the control of the controller 30B. The resolver 22, the mechanical brake 23, and the turning reduction gear 24 are connected to a rotational shaft 21A of the turning motor 21.

The sensor 21*s* includes a current sensor 21*s*1 and a voltage sensor 21*s*2.

The current sensor 21*s*1 detects the current of each of the three phases (U phase, V phase, and W phase) of the turning motor 21. The current sensor 21*s*1 is provided, for example, in a power path between the turning motor 21 and the inverter 18B. The detection signal corresponding to the current of each of the three phases of the turning motor 21 detected by the current sensor 21*s*1 may be directly entered into the inverter 18B through a communication line. Alternatively, the detection signal may be entered into the controller 30B via a communication line and input to the inverter 18B via the controller 30B.

The voltage sensor 21*s*2 detects the applied voltage of each of the three phases of the turning motor 21. The voltage sensor 21*s*2 is provided, for example, in the power path between the turning motor 21 and the inverter 18B. The detection signal corresponding to the applied voltage of each of the three phases of the turning motor 21 detected by the voltage sensor 21*s*2 is directly entered into the inverter 18B through a communication line. Alternatively, the detection signal may be entered into the controller 30B via a communication line and input to the inverter 18B via the controller 30B.

The resolver 22 detects a rotation state (for example, a rotation position (rotation angle) or a rotation speed) of the turning motor 21. The detection signal corresponding to the rotation angle or the like detected by the resolver 22 may be directly entered into the inverter 18B through a communication line. Alternatively, the detection signal may be entered into the controller 30B through a communication line and input to the inverter 18B through the controller 30B.

The mechanical brake 23 mechanically generates a braking force with respect to the rotational shaft 21A of the turning motor 21 under the control of the controller 30B. Accordingly, the mechanical brake 23 can turn and brake the upper turning body 3 or maintain the stopped state of the upper turning body 3.

The turning reduction gear 24 is connected to the rotational shaft 21A of the turning motor 21, and by decelerating the output (torque) of the turning motor 21 by a predetermined deceleration ratio, the torque is increased to drive the turning of the upper turning body 3. That is, during the power running operation, the turning motor 21 drives the turning of the upper turning body 3 via the turning reduction gear 24. Further, the turning reduction gear 24 increases the inertial rotation force of the upper turning body 3 and transmits the increased inertial rotation force to the turning motor 21 to generate regenerative power. That is, during the regenerative operation, the turning motor 21 generates regenerative power by the inertial rotation force of the upper turning body 3 transmitted via the turning reduction gear 24, and turns and brakes the upper turning body 3.

The inverter 18B drives and controls the turning motor 21 under the control of the controller 30B. The inverter 18B includes, for example, a conversion circuit for converting DC power to three-phase AC power or for converting three-phase AC power to DC power, a driving circuit that drives and switches the conversion circuit, and a control circuit for outputting a control signal (e.g., a PWM signal) for defining the operation of the driving circuit.

For example, the control circuit of the inverter 18B provides speed feedback control and torque feedback control relating to the turning motor 21 based on the detection signals of the current sensor 21*s*1, the voltage sensor 21*s*2, and the resolver 22.

At least one of the driving circuit and the control circuit of the inverter 18B may be provided outside the inverter 18B.

<Power Storage System>

The power storage system of the excavator according to the present embodiment includes the power storage device 19 and the power conversion device 100.

The power storage device 19 (an example of a high voltage power storage device) is charged (power is stored) by being connected to an external commercial power supply by a predetermined cable, and the charged (stored) power is supplied to the pump motor 12 or the turning motor 21. The power storage device 19 charges the generated power (regenerative power) of the turning motor 21. The power storage device 19 is, for example, a lithium ion battery and has a relatively high output voltage (e.g., several hundred volts).

The power conversion device 100 raises the voltage (step-up) of the power of the power storage device 19, lowers the voltage (step-down) of the generated power (regenerative power) from the pump motor 12 or the turning motor 21 via the inverters 18A and 18B, and stores the power in the power storage device 19. The power conversion device 100 switches between a step-up operation and a step-down operation so that the voltage value of a DC bus 110 is within a constant range, according to the operation state of the pump motor 12 and the turning motor 21. Switching control between a step-up operation and a step-down operation of the power conversion device 100 may be implemented by the controller 30B based on a voltage detection value of the DC bus 110, a voltage detection value of the power storage device 19, and a current detection value of the power storage device 19.

The power conversion device 100 may be omitted when it is not necessary to step-up the output voltage of the power storage device 19 and apply the raised voltage to the pump motor 12 or the turning motor 21.

<Operation System>

The operation system of the excavator according to the present embodiment includes the pilot pump 15, the operation device 26, and a pressure control valve 31.

The pilot pump 15 supplies pilot pressure to the pressure control valve 31 (e.g., a proportional valve) via a pilot line 25. Thus, the pressure control valve 31 can supply a pilot pressure to the control valve 17 according to the operation content (for example, the operation amount or the operation direction) with respect to the operation device 26, under the control of the controller 30A. The pilot pump 15 is, for example, a fixed displacement hydraulic pump, and is driven by the pump motor 12 as described above.

The operation device 26 includes, for example, levers 26A to 26C. The operation device 26 is positioned within reach of an operator seated on the operator seat in the cabin 10 and is used by the operator to operate the respective driven elements (i.e., the left and right crawlers of the lower traveling body 1, the upper turning body 3, the boom 4, the arm 5, the bucket 6, etc.). That is, the operation device 26 is used to operate hydraulic actuators (e.g., the traveling hydraulic motors 1A and 1B, the boom cylinder 7, the arm cylinder 8, the bucket cylinder 9, etc.) and electric actuators (the turning motor 21, etc.) that drive the respective driven elements. The operation device 26 is electric and outputs an electric signal (hereinafter, an "operation signal") according to the operation content by the operator. The operation signal output from the operation device 26 is entered into the controller 30A.

When the control valve 17 is configured by a solenoid (electromagnetic) pilot-type hydraulic control valve (directional change-over valve), the operation signal of the operation device 26 may be directly input to the control valve 17 and the respective hydraulic control valves may operate according to the operation content with respect to the operation device 26.

The pressure control valve 31 uses hydraulic oil supplied from the pilot pump 15 through the pilot line 25 to output pilot pressure according to the operation content with respect to the operation device 26, under the control of the controller 30A. The pilot line on the secondary side of the pressure control valve 31 is connected to the control valve 17, and the pilot pressure according to the operation content with respect to the operation device 26 is supplied to the control valve 17.

<Control System>

The control system of the excavator according to the present embodiment includes a control device 30, a surrounding information acquisition device 40, and a display device 50.

The control device 30 includes controllers 30A to 30C.

The functions of the controllers 30A to 30C may each be implemented by any piece of hardware or a combination of any hardware and software. For example, the controllers 30A to 30C may each be configured around a microcomputer including a processor such as a CPU (Central Processing Unit), a memory device (main storage device) such as RAM (Random Access Memory), a non-volatile auxiliary storage device such as ROM (Read Only Memory), and an interface device with respect to external elements.

The controller 30A cooperates with various controllers configuring the control device 30 including the controllers 30B and 30C to perform driving control of the excavator.

For example, the controller 30A outputs a control instruction to the pressure control valve 31 according to an operation signal input from the operation device 26 and outputs pilot pressure from the pressure control valve 31 according to the operation content with respect to the operation device 26. Thus, the controller 30A can implement the operation of the excavator (driven element) corresponding to the operation content with respect to the operation device 26 of an electric type.

For example, the controller 30A implements a remote operation of the excavator using the pressure control valve 31. Specifically, the controller 30A may output, to the pressure control valve 31, a control instruction corresponding to the content of a remote operation signal received from an external device, a voice sound input accepted from a person around the excavator, a remote operation specified by a gesture input, or the like. The pressure control valve 31 may then use the hydraulic oil supplied from the pilot pump 15 to output a pilot pressure corresponding to a control instruction from the controller 30A to apply the pilot pressure to the pilot port of the corresponding control valve in the control valve 17. Thus, the contents of the remote operation are applied to the operation of the control valve 17, and the hydraulic actuator implements the operation of various operating elements (driven elements) according to the contents of the remote operation.

For example, the controller 30A implements an automatic operation function of the excavator using the pressure control valve 31. Specifically, the controller 30A may output a control instruction corresponding to an operation instruction relating to the automatic operation function to the pressure control valve 31. Operating instructions may be generated by the controller 30A or may be generated by other control devices which implement control relating to the automatic operation function. The pressure control valve 31 may use the hydraulic oil supplied from the pilot pump 15 to output a pilot pressure corresponding to a control instruction from the controller 30A to apply the pilot pressure to the pilot port of the corresponding control valve in the control valve 17. Accordingly, the contents of the operation instruction relating to the automatic operation function are applied to the operation of the control valve 17, and the operation of various operation elements (driven elements) by the automatic operation function is implemented by the hydraulic actuator.

For example, the controller 30A may comprehensively control the operation of the entire excavator (various devices installed in the excavator) based on bidirectional communication with various controllers such as the controllers 30B and 30C.

Figure 3:
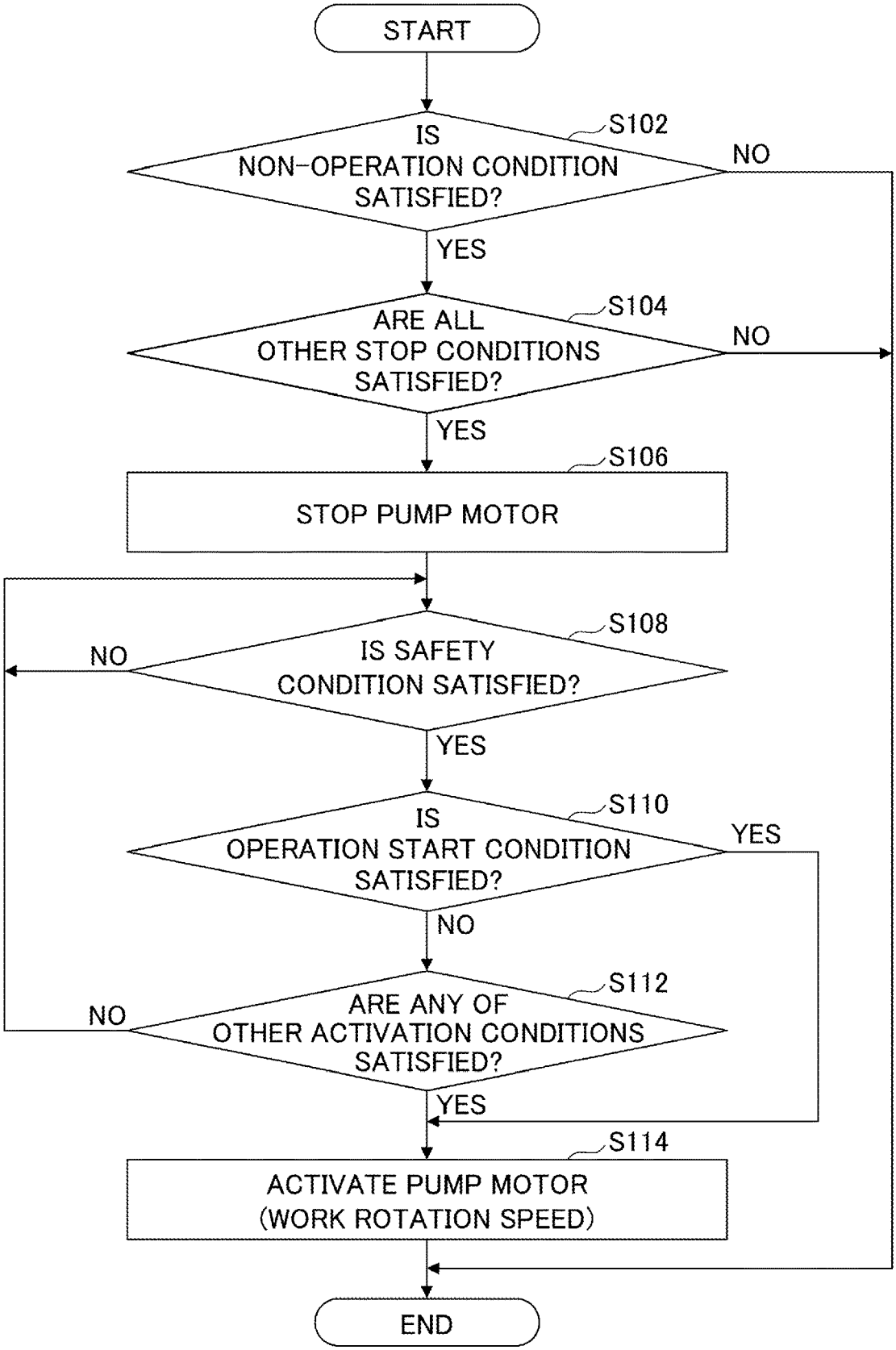
FIG. 3 is a flowchart schematically illustrating a first example of a control process relating to a pump stop function by a controller.
Figure 4:
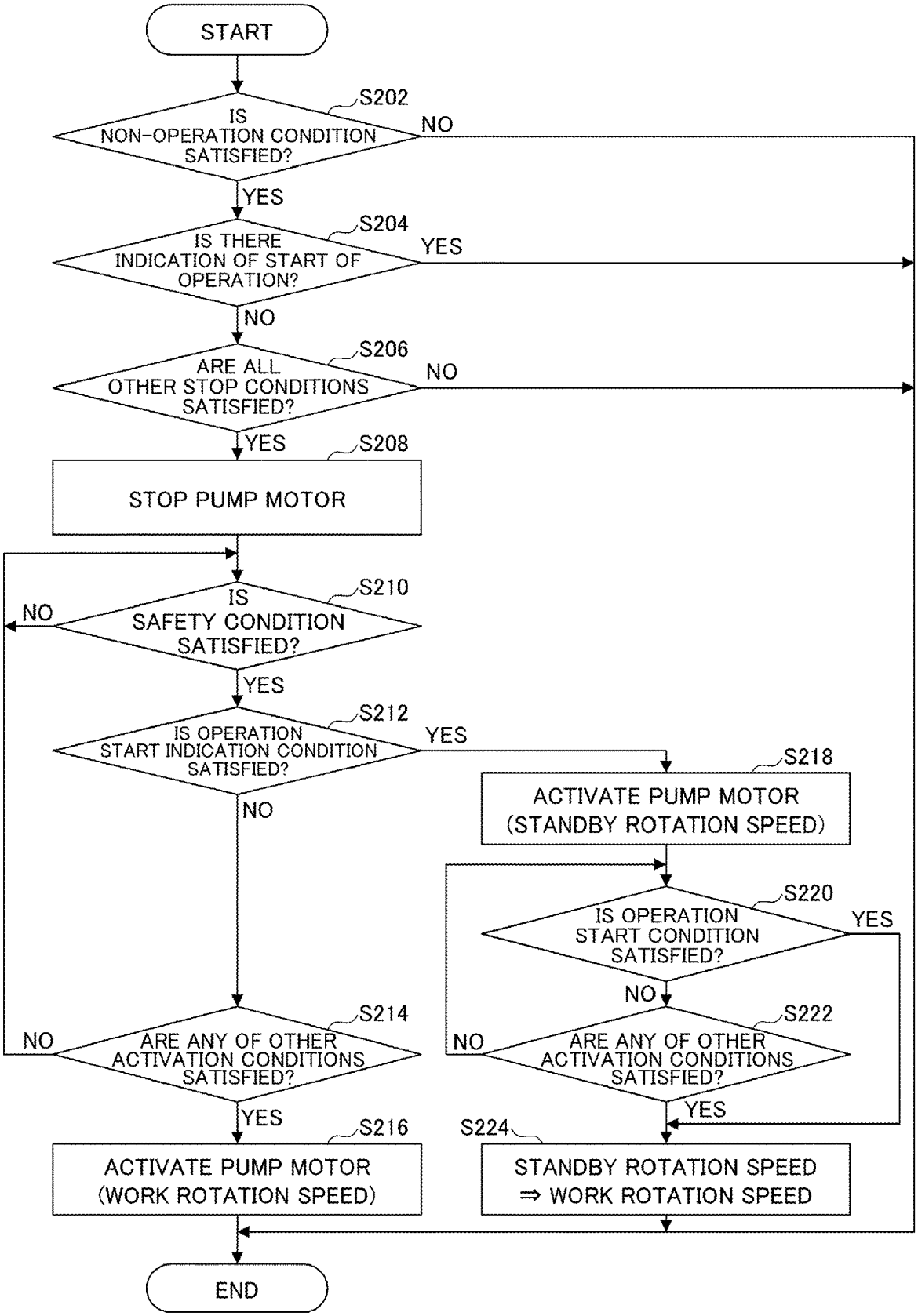
FIG. 4 is a flowchart schematically illustrating a second example of a control process relating to a pump stop function by a controller.

For example, the controller 30A automatically stops the main pump 14 when the operation device 26 is not operated while the excavator is in operation (i.e., while the key switch is turned on) (see FIGS. 3 and 4). Therefore, the main pump 14, that is, the pump motor 12, which is not needed when the excavator is not operated, is stopped, and, therefore, it is possible to reduce the consumption of the power in the power storage device 19 by the pump motor 12. Hereinafter, the function of automatically stopping the main pump 14 when the operation device 26 is not operated is referred to as a "pump stop function".

The control device 30 (the controllers 30A and 30B) activates the main pump 14, i.e., the pump motor 12 when the excavator is activated, that is, when the key switch is turned on, regardless of whether the operation device 26 is operated. This allows the control device 30 to activate the pump motor 12 once at the time of the activation of the excavator to shift the pump motor 12 to a controllable state. When the excavator is activated, the control device 30 can activate the pump motor 12 once and perform a process of diagnosing the presence or absence of an abnormality in the pump motor 12 and the like. For example, the controller 30B energizes the pump motor 12 through the inverter 18A to diagnose the presence or absence of an abnormality. The controller 30B may notify an operator of an abnormality in the pump motor 12 through the display device 50 or the like when there is an abnormality. On the other hand, the controller 30B may stop the pump motor 12 by means of a pump stop function, when there is no abnormality in the pump motor 12 and the operation with respect to the operation device 26 is not started subsequently.

The controller 30B performs drive control of the electric driving system and the power storage system based on various kinds of information (for example, a control instruction including an operation signal of the operation device 26) input from the controller 30A.

For example, the controller 30B drives the inverter 18B based on the operation content with respect to the operation device 26 and performs switching control of the operation state (power running operation and regenerative operation) of the turning motor 21.

For example, the controller 30B drives the power conversion device 100 based on the operation state of the operation device 26 and performs switching control between a step-up operation and a step-down operation of the power conversion device 100, that is, between the discharging state and the charging state of the power storage device 19.

For example, the controller 30B controls the stop and the activation of the pump motor 12 according to a control instruction relating to the pump stop function from the controller 30A (see FIGS. 3 and 4).

The controller 30C controls a surrounding monitoring function of the excavator.

For example, the controller 30C detects a predetermined object around the excavator and the position of the predetermined object (hereinafter, "monitor target") based on information relating to a status of the three-dimensional space around the excavator (for example, detection information relating to an object around the excavator or the position of the object) entered from the surrounding information acquisition device 40.

For example, the controller 30C outputs an alarm through the display device 50 or a voice sound output device in the interior of the cabin 10 when a monitor target is detected in a region that is relatively close to the excavator (hereinafter, the "monitor area").

The functions of the controllers 30B and 30C may be integrated into the controller 30A. That is, the various functions implemented by the control device 30 may be implemented by one controller or may be implemented by being distributed over two or more controllers set as appropriate.

The surrounding information acquisition device 40 outputs information relating to the status of the three-dimensional space around the excavator. The surrounding information acquisition device 40 may include, for example, an ultrasonic sensor, a millimeter wave radar, a monocular camera, a stereo camera, a depth camera, a LIDAR (Light Detection and Ranging), a distance image sensor, an infrared sensor, and the like. The output information of the surrounding information acquisition device 40 is entered into the controller 30C.

The display device 50 is disposed in a location within the cabin 10 that is easily visible from an operator, and displays various information images under the control of the controller 30A. The display device 50 is, for example, a liquid crystal display or an organic EL (electroluminescence) display.

The display device 50 may be operated under the control of a controller other than the controller 30A (e.g., the controller 30C).

<Other Elements>

The excavator according to the present embodiment includes an air conditioning device 42, an alternator 44, and a battery 46.

The air conditioning device 42 adjusts the temperature, the humidity, and the like in the interior of the cabin 10. The air conditioning device 42 may be, for example, a heat pump type for both cooling and warming, and includes a compressor 42*a*. The air conditioning device 42 may also include a heater for heating (e.g., a positive temperature coefficient (PTC) or a combustible heater).

The compressor 42*a* compresses a refrigerant in the heat pump cycle of the air conditioning device 42. The compressor 42*a* is driven by the pump motor 12.

The compressor 42*a* may be driven by a different motor than the pump motor 12 (e.g., a built-in motor operated by the power of the power storage device 19 or the battery 46).

The alternator 44 (an example of a power generating unit) generates power by the power of the pump motor 12. The generated power of the alternator 44 is supplied to the battery 46 and is charged (stored) in the battery 46 or supplied to a device driven by the power of the battery 46, such as the controllers 30A to 30C and the like.

The battery 46 (an example of a low voltage power storage device) has a relatively low output voltage (e.g., 24 volts) and supplies power to electric devices (e.g., the controllers 30A to 30C) other than the electric driving system that requires relatively high power. The battery 46 is, for example, a lead-acid battery and is charged with the generated power of the alternator 44 as described above.

The battery 46 may be charged with the power of the power storage device 19 supplied through a predetermined power conversion device (e.g., a DC (Direct Current)-DC converter). In this case, the alternator 44 may be omitted.

[Details of Pump Stop Function]

Next, a control process relating to the pump stop function by the control device 30 (the controllers 30A and 30B) will be described with reference to FIGS. 3 to 6.

First Example of Control Process Relating to Pump Stop Function

FIG. 3 is a flowchart schematically illustrating a first example of a control process relating to a pump stop function by the control device 30. The process of the flow chart is repeatedly executed at predetermined processing intervals during the operation from the activation to the stop of the excavator, for example. Hereinafter, the same may be applied to the flowcharts illustrated in FIGS. 4 to 6.

In step S102, the controller 30A determines whether a non-operation condition of the operation device 26 is satisfied based on an operation signal input from the operation device 26. The non-operation condition of the operation device 26 is, for example, "the operation device 26 is not operated". The non-operation condition of the operation device 26 may be, for example, "a state in which the operation device 26 is not operated is continuing for a predetermined period of time (for example, 10 seconds) or more". Hereinafter, the non-operation condition will be described on the assumption that the non-operation condition is one of the conditions for automatically stopping the main pump 14 (hereinafter, the "stop condition"). When the non-operation condition is satisfied, the controller 30A proceeds to step S104. When the non-operation condition is not satisfied, the controller 30A ends the current process.

In step S104, the controller 30A determines whether all of the other stop conditions other than the non-operation condition, are satisfied.

The stop condition may include, for example, a condition relating to the remaining capacity of the power storage device 19 ("the remaining capacity of the power storage device 19 is greater than or equal to a predetermined threshold value"). This is because, if the remaining capacity of the power storage device 19 is relatively low, it may not be possible to supply power for re-activating the stopped main pump 14 from the power storage device 19 to the pump motor 12. At this time, the remaining capacity of the power storage device 19 may be appropriately estimated using known methods based on, for example, a detection value of a sensor that measures the current, the voltage, or the like of the power storage device 19.

Further, the stop condition may include, for example, a condition relating to a state of deterioration of the power storage device 19 ("the deterioration of the power storage device 19 has not progressed beyond a predetermined reference"). If the deterioration of the power storage device 19 relatively progresses, it may not be possible to supply power for re-activating the stopped main pump 14 from the power storage device 19 to the pump motor 12. At this time, the deterioration state of the power storage device 19 may be appropriately estimated using known methods based on, for example, the detection value of a sensor that measures the current, the voltage, or the like of the power storage device 19.

Further, the stop condition may include, for example, a condition relating to the remaining capacity of the battery 46 ("the remaining capacity of the battery 46 is greater than or equal to a predetermined threshold value"). When the remaining capacity of the battery 46 becomes relatively low, there is a possibility that the alternator 44 no longer generates power while the pump motor 12 is stopped for stopping the main pump 14, resulting in insufficient power supply from the battery 46 to controllers 30A to 30C and the like. At this time, the remaining capacity of the battery 46 may be appropriately estimated, for example, in a manner similar to that of the power storage device 19. The remaining capacity of the battery 46 may also be calculated from a measurement value of the specific gravity meter of the battery fluid. This is because, as the voltage of the battery 46 drops, the specific gravity of the battery fluid changes significantly.

Further, the stop condition may include, for example, a condition relating to the deterioration of the battery 46 ("the deterioration of the battery 46 has not progressed beyond a predetermined reference"). If the deterioration of the battery 46 relatively progresses, there is a possibility that the alternator 44 no longer generates power while the pump motor 12 is stopped for stopping the main pump 14, resulting in insufficient power supply from the battery 46 to controllers 30A to 30C and the like. At this time, the deterioration state of the battery 46 may be appropriately estimated in the same manner as, for example, in the case of the power storage device 19.

Note that when the battery 46 is configured to be charged with power from the power storage device 19, the condition relating to the remaining capacity of the battery 46 and the condition relating to the deterioration state of the battery 46 may be omitted from the stop conditions. Further, when the battery 46 is configured to be charged with power from the power storage device 19 and the remaining capacity of the power storage device 19 is relatively high (i.e., the remaining capacity is sufficient to allow the battery 46 to be charged), then the condition relating to the remaining capacity of the battery 46 and the condition relating to the deterioration state of the battery 46 may be omitted from the stop conditions.

Further, the stop condition may include, for example, a condition relating to the excavator warm-up ("no excavator warm-up is required"). The excavator warm-up includes the warm-up of the hydraulic oil and the warm-up of the power storage device 19. If an excavator warm-up is required, the main pump 14 needs to be continuously activated to circulate hydraulic oil or to energize the portion between the power storage device 19 and a load. At this time, the necessity of the warm-up of the excavator may be determined based on a detection value of, for example, a 5' sensor for measuring the outside air temperature of the excavator or a sensor for measuring the temperature of the hydraulic oil discharged from the main pump 14.

The stop condition may also include, for example, a condition relating to air temperature (e.g., "the outside air temperature of the cabin 10 is within a predetermined range" or "the indoor temperature of the cabin 10 is within a predetermined range"). If the main pump 14 is stopped in a state where the temperature is very low or very high and is outside a predetermined range, the compressor 42*a* will stop as the pump motor 12 stops, and the comfort of the operator in the interior of the cabin 10 is highly likely to be compromised. At this time, the outside air temperature and the indoor temperature of the cabin 10 may be measured, for example, by a temperature sensor mounted outside the cabin 10 on the upper turning body 3 or a temperature sensor mounted in the interior of the cabin 10.

Note that when the air conditioning device 42 (the compressor 42*a*) is driven by power other than that of the pump motor 12, the condition relating to temperature may be omitted from the stop conditions.

Further, if the air conditioning device (the compressor 42*a*) is driven by an exclusive-use motor other than the pump motor 12 (hereinafter, "the air conditioning motor"), the stop condition may include a condition relating to the amount of available power of the power source (e.g., remaining capacity) for supplying power to the air conditioning motor. In this case, the stop condition may include, for example, "the amount of power for the air conditioning motor that can be supplied from the power source is relatively large (i.e., the amount of power is sufficient to allow the air conditioning motor to operate continuously for a certain period of time)".

Further, the stop condition may include, for example, a condition relating to the presence of a person around the excavator (e.g., "no person is present in a neighboring region around the excavator (the monitor area)"). This is because, when the main pump 14 of the excavator (the pump motor 12) stops, a worker around the excavator may mistake the excavator for being stopped (for the key switch being turned OFF) and may approach the excavator.

Further, the stop condition may include, for example, a condition relating to stability caused by the orientation of the excavator or the landform of the location of the excavator (e.g., "the excavator is not in a static unstable state" or "the excavator is not in a landform-related unstable state"). The static unstable state is a state of instability caused by the orientation of the excavator, and the landform-related unstable state is a state of instability caused by the landform of the location of the excavator. For example, when the excavator is in an unstable state due to the excavator's orientation or the landform of the location of the excavator, it may be necessary to move the driven element to avoid overturning of the excavator or the like, according to the operation by an operator with respect to the operation device 26.

The static unstable state of the excavator includes, for example, an orientation state in which the leading end of the attachment, that is, the position of the bucket 6 is relatively distant from the vehicle body of the excavator (such as the lower traveling body 1, the turning mechanism 2, and the upper turning body 3). This is because when the position of the bucket 6 is significantly relatively distant from the vehicle body, the moment in the direction in which the excavator is caused to overturn in the forward direction, acting on the vehicle body from the attachment (hereinafter, "the overturning moment") becomes relatively large, and it becomes relatively easy for the excavator to overturn. Also included in the static unstable state of the excavator is, for example, an orientation state in which the leading end of the attachment, i.e., the position of the bucket 6, is at a relatively high position. For example, if the excavator starts to overturn in the forward direction for some reason, such as due to the operation of the excavator or the application of an external force, and the position of the bucket 6 is relatively high, it becomes difficult to prevent the excavator from overturning by bringing the bucket 6 into contact with the ground. Further, the static unstable state of the excavator includes, for example, an orientation state in which the relative angle (turning angle) between the traveling direction of the lower traveling body 1 and the orientation of the upper turning body 3, that is, the orientation of the attachment, is relatively large. For example, the length at which the lower traveling body 1 contacts the ground is relatively smaller in the width direction than in the traveling direction, and when the orientation of the attachment is relatively close to the width direction of the lower traveling body 1, the excavator will easily overturn due to the weight of the attachment or the motion of the attachment.

The landform-related unstable state of the excavator may include, for example, a state in which the lower traveling body 1 slides forward or backward, or is highly likely to slide forward or backward, due to the landform effect, while the lower traveling body 1 is travelling or while the upper turning body 3 and the attachment are performing work. Further, the landform-related unstable state of the excavator may include a state in which a part of the lower traveling body 1 rises or is highly likely to rise, due to the landform effect, while the lower traveling body 1 is travelling or while the upper turning body 3 and the attachment are performing work. Further, the landform-related unstable state of the excavator may include a state in which the vehicle body of the excavator tilts or meanders, or is highly likely to tilt or meander, due to the landform effect, while the lower traveling body 1 is travelling or while the upper turning body 3 and the attachment are performing work. Further, the landform-related unstable state of the excavator may include, for example, a state in which the vehicle body vibrates or is highly likely to vibrate, due to the landform effect, while the lower traveling body 1 is travelling or while the upper turning body 3 and the attachment are performing work. The landform effect may include the land quality, the moisture on the ground, the slope of the ground, the unevenness of the ground, the collapse of the ground, or the like. In a simple context, the excavator's landform-related unstable state may be that the excavator is located on a sloping area.

When all of the other stop conditions are satisfied, the controller 30A proceeds to step S106. When any of the other stop conditions is not satisfied, the controller 30A ends the current process.

It may be possible to make a setting such that the pump stop function will not be performed, by the operator according to his or her own intention. For example, the pump stop function may be disabled (i.e., the pump stop function may be stopped) if a predetermined input is made through an input device provided in the cabin 10. In this case, even when the stop conditions of step S102 and step S104 are satisfied, the main pump 14 is not automatically stopped. The input device may include, for example, an operation input device that accepts an operation input from an operator or the like. The operation input device may include, for example, a touch panel mounted on the display device 50, a touch pad, a button, a toggle, a lever, or the like provided separately from the display device 50. For example, the pump stop function may be disabled according to an ON operation to the operation input device (an ON operation with respect to, for example, an exclusive-use button switch or a virtual button icon displayed on the display device 50). Further, the input device may include, for example, a voice sound input device or a gesture input device for accepting voice sound or gesture input from an operator. For example, the pump stop function may be disabled when a predetermined voice sound input or a predetermined gesture input is accepted from an operator.

In step S106, the controller 30B stops the pump motor 12 according to a control instruction from the controller 30A. This stops the main pump 14. Accordingly, the pump motor 12 is stopped when the operation device 26 is not operated, and, therefore, the power of the power storage device 19 consumed by the pump motor 12 can be reduced. Thus, the excavator can continue to operate for a longer time by the power of the power storage device 19.

In the stopped state of the main pump 14 (the pump motor 12) as a result of the process of step S106, functions other than functions for driving the hydraulic actuator are maintained in an enabled state. For example, in the stopped state of the main pump 14 (the pump motor 12), the surrounding monitoring function continues to operate. Accordingly, the controller 30C can detect a monitor target that enters a neighboring region around the excavator and report this to the operator or the like by an alarm or the like even while the work by the excavator is being temporarily paused.

In the stopped state of the main pump 14 (the pump motor 12) as a result of the process of step S106, the controller 30A may visually report, through the display device 50 (an example of the reporting unit), that the excavator is in operation, that is, the excavator is not in a stopped state (key switch OFF). The controller 30A may also visually report, through the display device 50, that the main pump 14 is automatically stopped while the excavator continues to operate. This allows the operator to recognize that the main pump 14 is automatically stopped while the excavator is still in operation, according to the non-operation state of the operation device 26. Instead of or together with the above, the controller 30A may visually report, through the display device 50, that the main pump 14 will be activated by an operation with respect to the operation device 26. This allows the operator to recognize that once the operation of the operation device 26 is started, the main pump 14 can be activated and work can be resumed.

The controller 30A may provide these reports by another method instead of or in addition to using the display device 50. For example, the controller 30A may provide a report in an auditory manner through a voice sound output device (e.g., a speaker) (e.g., an example of a reporting unit) installed in the interior of the cabin 10.

In step S108, the controller 30A determines whether the condition relating to the safety of the excavator (hereinafter, "safety condition") for activating the main pump 14 is satisfied.

The safety condition may include, for example, a condition relating to a seat belt wearing state ("the seat belt of the operator seat in the cabin 10 is worn"). At this time, whether the seat belt is worn may be determined based on, for example, output information of a switch for detecting whether the seat belt is worn, that is built into the seat belt buckle.

Further, the safety condition may include, for example, a condition relating to a gate lever in the cabin 10 ("gate lever is raised"). At this time, whether the gate lever is raised may be determined based on output information of a gate lever switch that detects the state of the gate lever.

Further, the safety condition may include, for example, a condition relating to the opening and closing state of the window and the door of the cabin 10 ("the window and the door of the cabin 10 are closed"). At this time, the opening and closing state of the window or the door of the cabin 10 may be determined based on output information of a switch which detects the opening and closing state of the window or the door, for example, which is installed in the window or the door.

Further, the safety condition may include, for example, a condition relating to the opening and closing state of an opening used for maintenance of the upper turning body. 3 (for example, the engine hood on the upper surface of the house part, the maintenance door on the side of the house part, etc.) ("all of the maintenance openings are closed"). This is because there is a possibility that service personnel, etc., is performing maintenance on the excavator when work by the excavator is temporarily paused. At this time, the opening and closing state of the maintenance opening may be determined based on output information of a switch for detecting whether the lid, the door, or the like, which is installed in the maintenance opening, is closing up the opening.

When all the safety conditions are satisfied, the controller 30A proceeds to step S110, and when the safety conditions are not satisfied, the controller 30A waits until the safety conditions are satisfied (the process in step S108 is repeated).

When the safety condition of step S108 is not satisfied, the controller 30A may report that the main pump 14 cannot be activated, through the above-described display device 50 (an example of the reporting unit) or the voice sound output device (an example of the reporting unit). Further, the controller 30A may specifically report the reason why the main pump 14 cannot be activated. This allows the operator to recognize that the main pump 14 cannot be activated due to the excavator's safety problems.

In step S110, the controller 30A determines whether an operation start condition of the operation device 26 has been satisfied, that is, whether the operation with respect to the operation device 26 has been resumed, based on an operation signal input from the operation device 26. Hereinafter, the description will be given on the assumption that the operation start condition is one of the conditions for automatically activating the main pump 14 (hereinafter, the "activation condition"). When the operation start condition is not satisfied, the controller 30A proceeds to step S112, and when the operation start condition is satisfied, the controller 30A proceeds to step S114.

In step S110, the controller 30A determines whether any of the other activation conditions are satisfied.

For example, the activation condition may include a condition relating to the remaining capacity of the power storage device 19 ("the remaining capacity of the power storage device 19 is less than a predetermined threshold value"), as is the case for the stop condition. This is because, for example, in a configuration in which the battery 46 can be charged with the power of the power storage device 19, when the stop period of the main pump 14 becomes relatively long, the remaining capacity of the power storage device 19 may become relatively low. In this case, the "threshold value" of the stop condition and the "threshold value" of the activation condition may be the same or different.

Note that when the battery 46 is configured not to be charged by the power of the power storage device 19, the condition relating to the remaining capacity of the power storage device 19 may be omitted from the activation condition.

Further, the activation condition may include, for example, a condition relating to the remaining capacity of the battery 46 ("the remaining capacity of the battery 46 is less than a predetermined threshold value"), as in the case of the stop condition. In the configuration in which the battery 46 is charged by the power generated by the alternator 44 driven by the pump motor 12, when the stop period of the main pump 14 becomes relatively long, the remaining capacity of the battery 46 may become relatively small. In this case, the "threshold value" of the stop condition and the "threshold value" of the activation condition may be the same or different.

Note that when the battery 46 is configured to be charged by the power of the power storage device 19, the condition relating to the remaining capacity of the battery 46 may be omitted from the activation condition.

Further, the activation condition may include, for example, a condition relating to the indoor temperature of the cabin 10 (e.g., "the indoor temperature of the cabin 10 is outside a predetermined range"). This is because, when the stop period of the main pump 14 becomes relatively long, the indoor temperature of the cabin 10 may increase or decrease, and the comfort of the operator in the cabin 10 is likely to be compromised. In this case, the "predetermined range" of the stop condition and the "predetermined range" of the activation condition may be the same or may be different.

The activation condition may also include, for example, a condition relating to the presence of a person around the excavator (e.g. "a person is present in a neighboring region (the monitor area) around the excavator", etc.). This is because, when the main pump 14 of the excavator (the pump motor 12) is stopped, a worker around the excavator may mistake the excavator for being stopped (for the key switch being turned OFF) and may approach the excavator.

Further, the activation condition may include, for example, a condition relating to stability caused by the orientation of the excavator or the landform of the location of the excavator (e.g., "the excavator is in a static unstable state" or "the excavator is in a landform-related unstable state"). After the stop condition is satisfied, when a landform variation occurs at the location of the excavator for some reason (e.g., an earthquake, etc.), and as a result, the excavator is in an unstable condition, it may be required to operate the driven element according to the operation by the operator with respect to the operation device 26, to avoid the overturning, etc., of the excavator.

Further, the activation condition may include, for example, a condition relating to the forced cancellation of the main pump stop function according to an operator's intention (e.g., "a predetermined input for forcibly cancelling the stopped state of the main pump 14, can be accepted from the operator via an input device provided in the cabin 10"). This allows the operator to forcibly cancel the stopped state of the main pump 14 according to the pump stop function.

When any of the other activation conditions are satisfied, the controller 30A proceeds to step S114. When not satisfied, the controller 30A returns to step S108 and repeats the processes of steps S108 to S112.

In step S114, the controller 30B activates the pump motor 12 according to a control instruction from the controller 30A. Then, the controller 30B restores the rotation speed of the main pump 14 to a predetermined rotation speed at which the excavator can operate the hydraulic actuator to start the work (hereinafter, the "work rotation speed"), and ends the current process. This allows the operator to activate the main pump 14 and resume the work with the excavator by operating the operation device 26.

The controller 30B may increase the rotation speed (revolution speed) of the pump motor 12 (i.e., the main pump 14) at the same rate of increase every time the pump motor 12 is activated. The controller 30B may also vary the rate of increase of the rotation speed of the pump motor 12 according to a predetermined condition when the pump motor 12 is activated. In this case, the controller 30B may be configured to continuously vary the rate of increase of the rotation speed of the pump motor 12 according to a predetermined condition, or may be configured to include a plurality of control modes in which the rate of increase of the rotation speed of the pump motor 12 is different between the control modes.

For example, the controller 30B may vary the rate of increase of the rotation speed of the pump motor 12 according to the operation content with respect to the operation device 26 when the operation start condition is satisfied. Specifically, as the operation amount or the operation speed with respect to the operation device 26 relatively increases when the operation start condition is satisfied, the controller 30B may relatively increase the rate of increase of the rotation speed of the pump motor 12. This is because it is presumed that the operator's intention to quickly start work with the excavator, is reflected in the operation content. On the other hand, the controller 30B may relatively decrease the rate of increase of the rotation speed of the pump motor 12 as the operation amount or the operation speed with respect to the operation device 26 relatively decreases when the operation start condition is satisfied. This is because the operator's intention to quickly start work with the excavator, is not reflected in the operation content, so it is considered that it is better to reduce energy consumption (consumption of power supplied from the power storage device 19) by slowing down the rate of increase of the rotation speed.

For example, the excavator may be provided with a plurality of operation modes relating to energy consumption, work efficiency, and the like. The plurality of operation modes may include an energy saving mode to prioritize the reduction of energy consumption, a work priority mode to prioritize work efficiency, a balance mode to place importance on the balance between energy consumption and work efficiency, and the like. The operation mode of the excavator may be set to a balance mode, for example, as an initial state. The control device 30 may then set any operation mode from among a plurality of operation modes according to a predetermined input from an operator accepted through an input device provided in the cabin 10. In this case, the controller 30B may control the pump motor 12 in such a manner that, as the operation mode becomes a mode having a higher priority in the operation efficiency among a plurality of operation modes, the rate of increase of the rotation speed is relatively increased when activating the pump motor 12. This allows the controller 30B to more quickly restore the rotation speed of the main pump 14 to the work rotation speed, and assist the excavator in more quickly starting the work. On the other hand, the controller 30B may control the pump motor 12 in such a manner that, as the operation mode becomes a mode having a relatively higher priority in the reduction of energy consumption among a plurality of operation modes, the rate of increase of the rotation speed is relatively decreased when activating the pump motor 12. This allows the controller 30B to relatively gradually increase the rotation speed of the pump motor 12, to relatively reduce the energy consumption (the consumption of power supplied from the power storage device 19).

Second Example of Control Process Relating to Pump Stop Function

FIG. 4 is a flowchart schematically illustrating a second example of a control process relating to a pump stop function by the control device 30 (the controllers 30A and 30B).

In step S202, as in step S102 of FIG. 3, the controller 30A determines whether the non-operation condition of the operation device 26 is satisfied based on an operation signal input from the operation device 26. When the non-operation condition is satisfied, the controller 30A proceeds to step S204. When the non-operation condition is not satisfied, the controller 30A ends the current process.

In step S204, the controller 30A determines whether there is any indication that an operation with respect to the operation device 26 will start. The controller 30A may determine that there is an indication that operation with respect to the operation device 26 will start, for example, when an operator is touching the operation device 26. At this time, the controller 30A may determine whether an operator is touching the operation device 26 based on information output from, for example, a camera for capturing images of the interior of the cabin 10 or a sensor for detecting contact with the operation device 26 mounted in the handle portion of the operation device 26. Further, the controller 30A may determine that the operator is touching the operation device 26, for example, when the waveform of the operation signals in time series output from the operation device 26 represents a minute vibration near a zero operation amount. The controller 30A proceeds to step S206 when there is no indication that an operation with respect to the operation device 26 will start, and ends the current operation when there is any indication that an operation with respect to the operation device 26 will start.

For example, in a case where, immediately after the main pump 14 is stopped, an operation with respect to the operation device 26 is started, and the main pump 14 is immediately activated again, there may be a time lag (waiting time) before the operator is able to start work. On the other hand, in the present example, in a situation where the operation device 26 is not yet operated but the operation is about to start immediately, the main pump 14 will not be stopped. Accordingly, it is possible to prevent a situation in which the operator feels annoyed with the stopping of the main pump 14 and the activating of the main pump 14 immediately thereafter, or a situation in which the operation efficiency of the excavator is degraded due to the waiting time until the main pump 14 returns to the work rotation speed.

Steps S206 to S210 are the same processes as steps S104 to S108 of FIG. 3, and thus the descriptions thereof will be omitted.

In step S212, the controller 30A determines whether a condition relating to an indication that an operation with respect to the operation device 26 will start (hereinafter, an "operation start indication condition"), is satisfied, that is, whether there is an indication that an operation with respect to the operation device 26 will start. The controller 30A proceeds to step S214 when the operation start indication condition is not satisfied, and to step S218 when the operation start indication condition is satisfied.

Step S214 and step S216 are the same processes as step S112 and step S114 of FIG. 3, and thus the description thereof will be omitted.

On the other hand, in step S218, the controller 30B activates the pump motor 12 according to a control instruction from the controller 30A. Then, the controller 30B causes the rotation speed of the main pump 14 to return to a standby rotation speed (an example of the second rotation speed) that is lower than the work rotation speed (an example of the first rotation speed), and the controller 30A proceeds to step S220.

In step S220, the controller 30A determines whether the operation start condition is satisfied. When the operation start condition is not satisfied, the controller 30A proceeds to step S222, and when the operation start condition is satisfied, the controller 30A proceeds to step S224.

In step S222, the controller 30A determines whether any of the other activation conditions are satisfied. When any of the other activation conditions are satisfied, the controller 30A proceeds to step S222. When not satisfied, the controller returns to step S220 and repeats the processes of steps S220 and S222.

In step S224, the controller 30B causes the rotation speed of the main pump 14 to return (increase) from the standby rotation speed to the work rotation speed according to a control instruction from the controller 30A, and ends the current process. Accordingly, the rotation speed of the main pump 14 can be increased to the work rotation speed as soon as an operation with respect to the operation device 26 is actually started. Therefore, it is possible to further reduce the waiting time from the start of operation with respect to the operation device 26 to the actual start of work, thereby further reducing the decrease in the work efficiency of the excavator. Further, while waiting for the start of an operation with respect to the operation device 26, the main pump 14 rotates at a standby rotation speed that is lower than the work rotation speed, and, therefore, it is possible to prevent a decrease in the work efficiency of the excavator while reducing the consumption of the power of the power storage device 19 by the pump motor 12.

Third Example of Control Process Relating to Pump Stop Function

Figure 5:
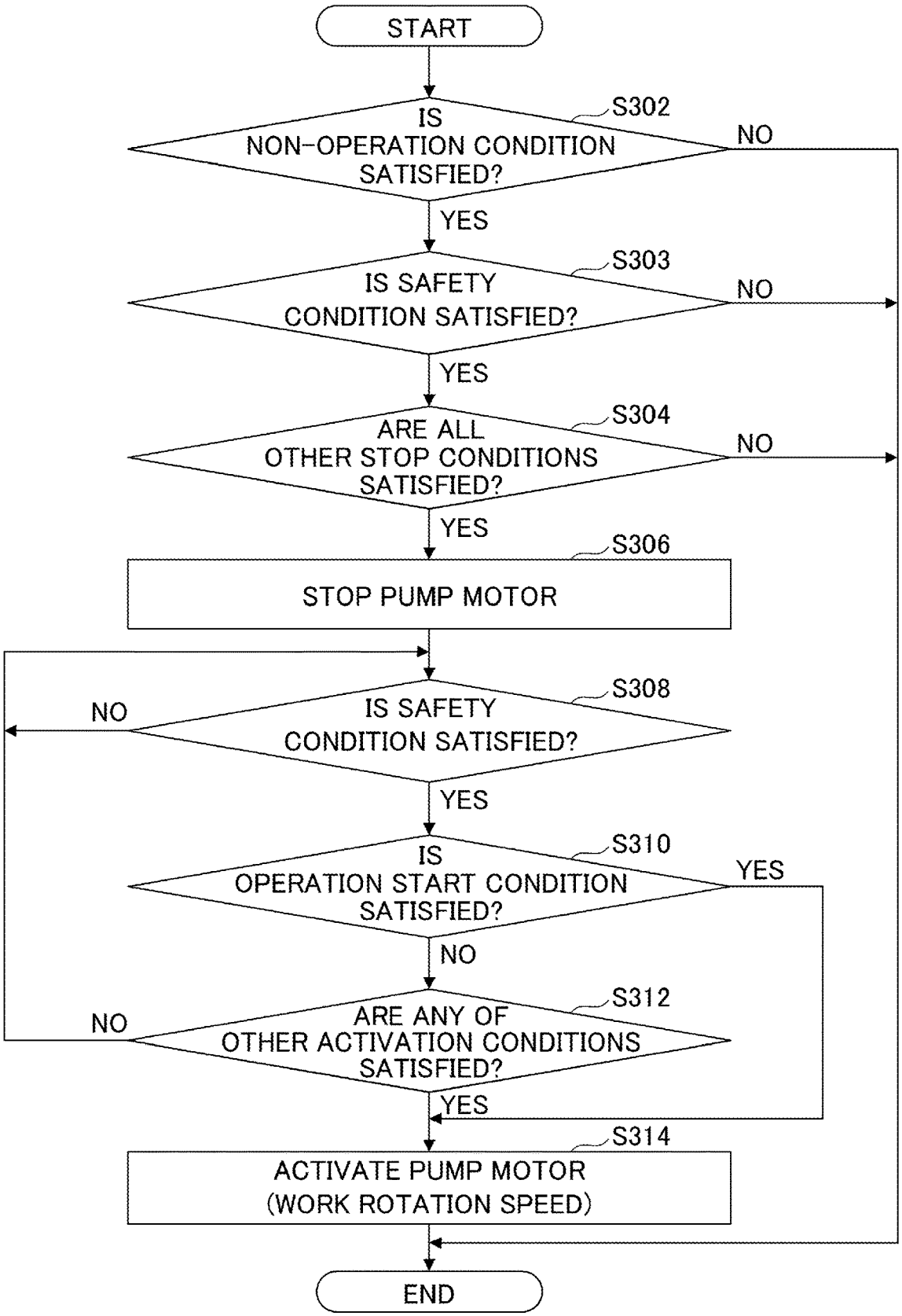
FIG. 5 is a flowchart schematically illustrating a third example of a control process relating to a pump stop function by a controller.

FIG. 5 is a flowchart schematically illustrating a third example of a control process relating to a pump stop function by the control device 30 (the controllers 30A and 30B).

In step S302, the controller 30A determines whether the non-operation condition of the operation device 26 is satisfied based on an operation signal input from the operation device 26. When the non-operation condition is satisfied, the controller 30A proceeds to step S303. When the non-operation condition is not satisfied, the controller 30A ends the current process.

In step S303, the controller 30A determines whether the safety condition is satisfied. When all of the safety conditions are satisfied, the controller 30A proceeds to step S304, and when the safety conditions are not satisfied, the controller 30A ends the current process. This allows the controller 30A to prevent the main pump 14 from automatically stopping when the safety conditions are not satisfied.

When the safety condition of step S303 is not satisfied, the controller 30A may notify, through the above-described display device 50 or the voice sound output device, that the main pump 14 cannot be automatically stopped. The controller 30A may specifically notify the reason why the main pump 14 cannot be automatically stopped. This allows the operator to recognize that the main pump 14 is not automatically stopped due to the excavator's safety problems.

Note that the order of executing steps S302 and S303 may be reversed. The process of step S303 may be set between the process of step S304 and the process of step S306.

The processes of steps S304 to S314 are the same as those of steps S104 to S114 in FIG. 3, and, therefore, the description thereof will be omitted.

The same process as in step S303 may be applied to the flowchart illustrated in FIG. 4.

Fourth Example of Control Process Relating to Pump Stop Function

Figure 6:
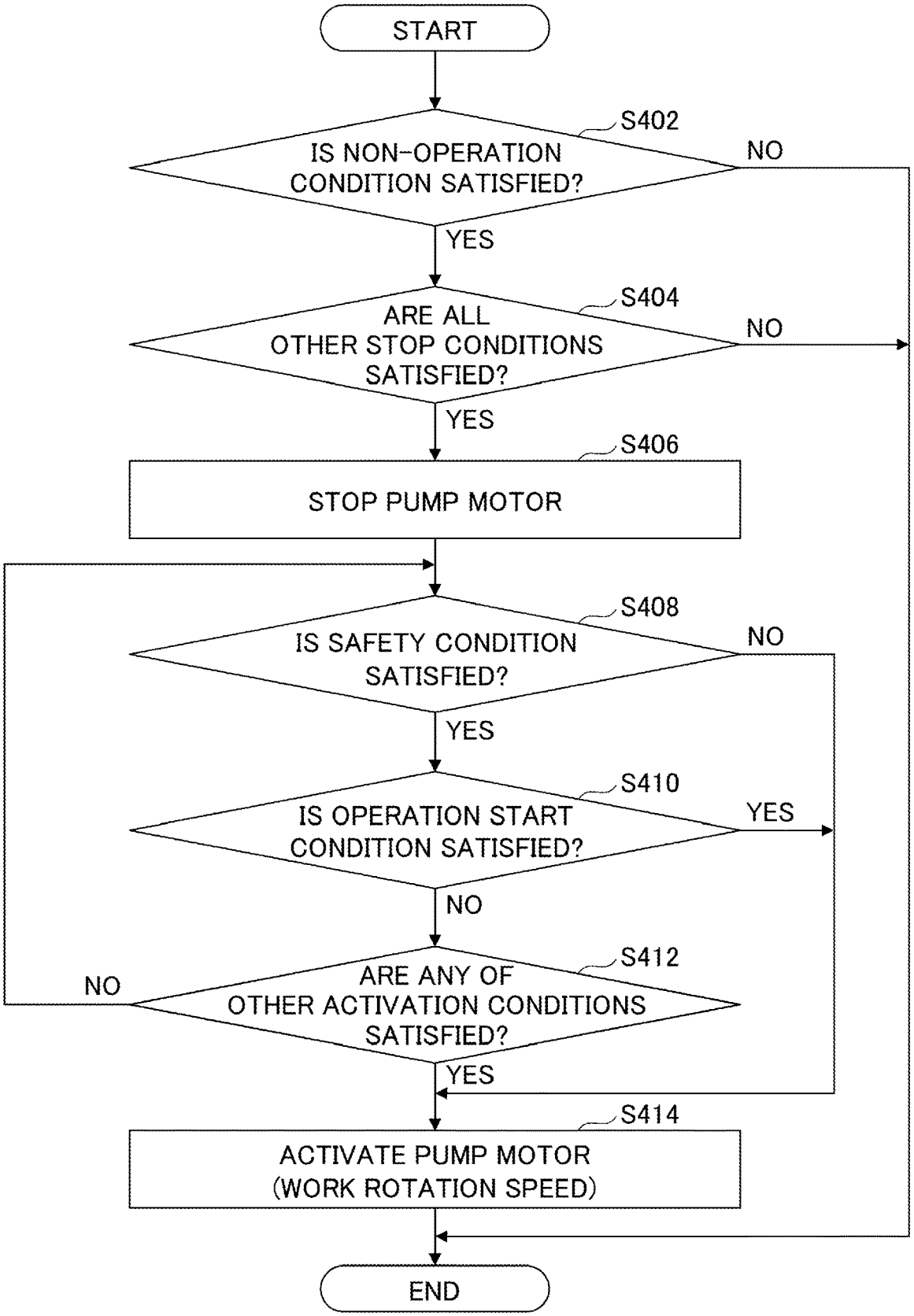
FIG. 6 is a flowchart schematically illustrating a fourth example of a control process relating to a pump stop function by a controller.

FIG. 6 is a flowchart schematically illustrating a fourth example of a control process relating to a pump stop function by the control device 30 (the controllers 30A and 30B).

The processes of steps S402 to S406 are the same as those of steps S102 to S106 of FIG. 3, and, therefore, the description thereof will be omitted.

In step S408, the controller 30A determines whether the safety condition is satisfied. When all the safety conditions are satisfied, the controller 30A proceeds to step S410, and when the safety conditions are not satisfied, the controller 30A proceeds to step S414. This allows the controller 30A to reactivate the main pump when the safety conditions are not satisfied.

For example, if the main pump 14 (the pump motor 12) is automatically stopped due to the non-operation state of the hydraulic actuator, and this state continues, the operator may mistake the key switch for being turned off, and may leave the site of the excavator. As a result, the current consumption of the battery 46 supplying power to the control device 30 may greatly reduce the remaining capacity of the battery 46 or greatly reduce the remaining capacity of the power storage device 19 capable of charging the battery 46.

In contrast, in the present example, when the safety conditions are not satisfied due to the operator removing the seat belt, lowering the gate lever, or opening the door, the pump motor 12 reactivates. Therefore, the operator can notice that the key switch of the excavator is not turned off.

When any one of the plurality of conditions included in the safety conditions is not satisfied, as illustrated in step S108 of FIG. 3, the process of step S408 may be repeated, and when the plurality of conditions included in the safety conditions (for example, the condition relating to the gate lock and the condition relating to the seat belt) are not satisfied, the process of step S408 may be performed (that is, the process proceeds to step S414).

The processes of steps S410 to S414 are the same as the processes of steps S110 to S114 of FIG. 3, and, therefore, the description thereof will be omitted.

The same process as in step S408 may be applied to the flowchart illustrated in FIG. 4.

Other Examples of Control Process Relating to Pump Stop Function

The control device 30 (the controllers 30A and 30B) may perform the same control processes as described above for the first to fourth examples in a state where the excavator is remotely operated. In this case, the non-operation conditions of the operation device 26 in the above-described first to fourth examples are replaced by a non-operation condition of driven elements that are remotely operated (i.e., actuators that drive the driven elements). The non-operation condition of the remotely operated driven element may be, for example, "an operation relating to the remotely operated driven element is not performed" or "a state in which an operation relating to the remotely operated driven element is not performed is continuing for a predetermined period of time or longer" as in the above-described first to fourth examples.

For example, when an excavator is remotely operated according to a remote operation signal received from an external device, the non-operation condition of the driven element according to remote operation corresponds to the non-operation condition of an operation device used for remote operation (hereinafter, the "remote operation device") provided in an external device. In the case of a specification in which a remote operation signal is transmitted to the excavator regardless of the operation of the remote operation device, the controller 30A may determine whether the non-operation condition of the remote operation device is satisfied based on the operation content (data relating to the amount of operation) included in the remote operation signal. Further, in the case of a specification in which a remote operation signal is transmitted to the excavator only when the remote operation device is operated, the controller 30A can determine whether the non-operation condition of the remote operation device is satisfied based on whether the remote operation signal is received.

The control device 30 (the controllers 30A and 30B) may perform the same control process as the above-described first to fourth examples in a state where the excavator is operating by a fully automatic operation function. In this case, the non-operation conditions of the operation device 26 in the above-described first to fourth examples are replaced by a non-operation condition of driven elements that are operated by a fully automatic operation function (i.e., the actuators that drive the driven elements). The non-operation condition of the driven elements that are operated by the fully automatic operation function may be, for example, "the operation instruction for operating the driven element is not output" or "the state in which the operation instruction for operating the driven element is not output is continuing for a predetermined period of time or longer" as in the above-described first to fourth examples.

Thus, in this example, the control device 30 may stop the pump motor 12 driving the main pump 14 when no operation is performed with respect to the driven element, in a state where the excavator is remotely operated or operated by a fully automatic operation function. Therefore, the excavator can reduce the power consumption of the pump motor 12 even when the excavator is remotely operated or operated by a fully automatic operation function.

[Functions]

Next, the effects of the excavator according to the present embodiment will be described.

According to the present embodiment, the excavator includes the main pump 14 for supplying hydraulic oil to the hydraulic actuator, the pump motor 12 for driving the main pump 14, the operation device 26 for operating the hydraulic actuator, and the control device 30. The control device 30 controls the pump motor 12 to automatically stop the main pump 14 when an operation with respect to the operation device 26 is not performed and then automatically activates the main pump 14 when an operation with respect to the operation device 26 is started.

Accordingly, the pump motor 12 for driving the main pump 14 can be stopped when the operation device 26 is not operated. Therefore, the excavator according to the present embodiment can reduce energy consumption (power consumption).

Further, if the operation device 26 is a hydraulic pilot type, the activation of the pilot pump 15 needs to continue in order to detect the start of the operation with respect to the operation device 26 in the stopped state of the main pump 14. Accordingly, another motor that is different from the pump motor 12 is added and the other motor continues to drive the pilot pump 15 with power supplied from the power storage device 19 during the stopped state of the main pump 14. Accordingly, there is a high possibility that the power of the power storage device 19 is consumed to some extent by the other motor driving the pilot pump 15 even when the operation device 26 is not operated.

On the other hand, according to the present embodiment, the operation device 26 is an electric type, and, therefore, it is not necessary to continue the activation of the pilot pump 15 when the main pump 14 is in the stopped state, and the pilot pump 15 can also be stopped in conjunction with the stopping of the main pump 14. Therefore, the excavator according to the present embodiment can further reduce energy consumption (power consumption).

[Modification/Variation]

While the embodiments of the present invention have been described in detail above, the present invention is not limited to such specific embodiments, and various modifications and variations are possible within the scope of the present invention as defined in the appended claims.

For example, in the embodiments described above, the controller 30A may provide a notification to the operator via the display device 50 or the like, to prompt the operator to turn the key switch OFF in a situation such as when the operator leaves the cabin 10. This is because, for example, when the operator leaves the cabin 10 while the key switch is on, the pump stop function will be activated according to a state in which operation input with respect to a hydraulic actuator is not made, which is undesirable from the viewpoint of safety, economic efficiency, and the like. Specifically, the controller 30A may output the notification when the excavator is activated or when the main pump 14 is stopped by the pump stop function.

Further, in the above-described embodiments and modification/variation examples, if the excavator is connected to an external commercial power supply and the power storage device 19 is charged, the pump stop function may be disabled (stopped). Typically, it is recommended that the key switch be turned OFF when the excavator is connected to an external power supply and the power storage device 19 is charged. Therefore, it is undesirable that the pump stop function is performed from the viewpoint of safety or the like even when the key switch is turned on for some reason.

Further, in the above-described embodiments and modification/variation examples, the excavator is what is referred to as a "battery excavator" powered by the power storage device 19, but the excavator may be a "hybrid excavator" of a series-type.

Figure 7:
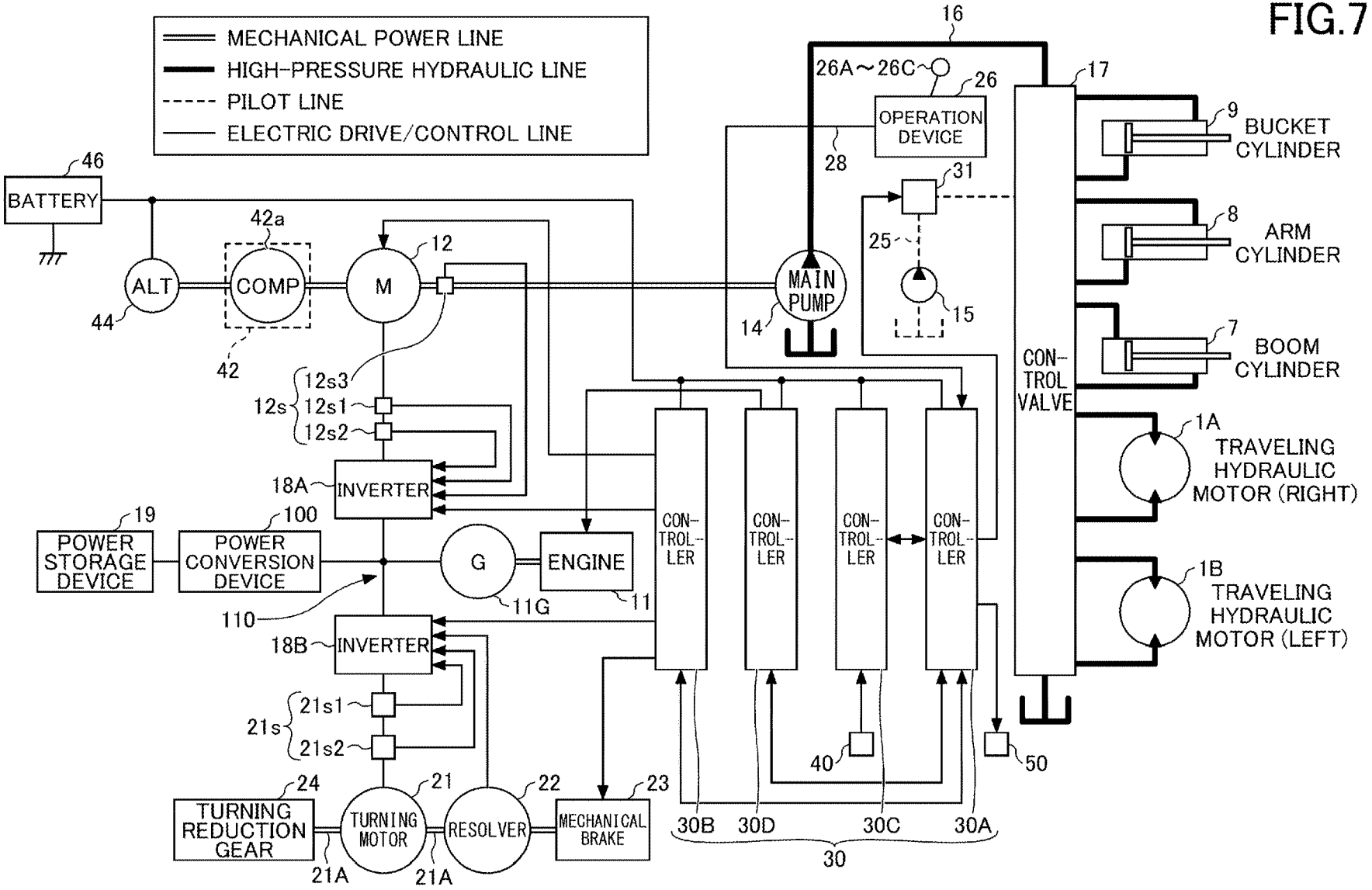
FIG. 7 is a block diagram schematically illustrating another example of a configuration of an excavator.

For example, FIG. 7 is a block diagram schematically illustrating another example of a configuration of an excavator according to the present embodiment. Hereinafter, portions different from those of FIG. 2 will be mainly described.

As illustrated in FIG. 7, the excavator in this example is a "hybrid excavator" of a series-type.

Specifically, the excavator of the present example includes an engine 11 and an electric generator 11G driven by the engine 11. The control device 30 includes a controller 30D for controlling the engine 11 in addition to the controllers 30A to 30C.

The electric generator 11G is connected to a DC bus 110 through a rectifier (not illustrated), a voltage regulating converter (not illustrated), and the like. The power generated by the electric generator 11G is charged to the power storage device 19 from the DC bus 110 via the power conversion device 100 or is supplied to the pump motor 12 or the turning motor 21 via inverters 18A and 18B.

The controller 30D performs drive control of the engine 11 based on various kinds of information input from the controller 30A (for example, control instructions relating to the set rotation speed of the engine 11 and the operation and stop of the engine 11). Specifically, the controller 30D implements drive control of the engine 11 by outputting a control instruction to an actuator such as a starter motor to be controlled or a fuel injector of the engine 11.

The controller 30A stops the engine 11, for example, through the controller 30D, when the remaining capacity of the power storage device 19 is relatively large, and operates the engine 11 to cause the electric generator 11G to generate power when the remaining capacity of the power storage device 19 is relatively small.

For the excavator of the present example, the control process relating to the pump stop function similar to the above-described embodiment (see FIGS. 3 to 6) may be applied. Thus, the excavator of the present example has the same functions and effects as the above-described embodiment.

Further, in the above-described embodiments and modification/variation examples, the excavator may be replaced by any work machine (e.g., an industrial vehicle, a forklift, a crane, etc.) that drives a hydraulic pump that supplies hydraulic oil to the hydraulic actuator by an electric motor.

According to an aspect of the present invention, a technique by which energy consumption of the excavator is further reduced, can be provided.

What is claimed is:

1. An excavator comprising:

a lower traveling body;

an upper turning body turnably mounted to the lower traveling body;

a work attachment attached to the upper turning body;

an imaging device mounted to the upper turning body;

a hydraulic actuator;

a hydraulic pump configured to supply hydraulic oil to the hydraulic actuator;

an electric motor configured to drive the hydraulic pump;

an operation device of an electric type configured to operate the hydraulic actuator; and a control device configured to control the electric motor, wherein in response to determining that the operation device is not operated, the control device causes the hydraulic pump to automatically stop, and subsequently. in response to determining that an operation with respect to the operation device is started, the control device causes the hydraulic pump to be automatically activated, and even when the operation with respect to the operation device is started after causing the hydraulic pump to automatically stop, in response to determining that a seat belt of an operator seat in the excavator is not worn, a window or a door of a cabin of the excavator is not closed, or an opening for maintenance in the excavator is not closed, the control device does not cause the hydraulic pump to be automatically activated.

2. The excavator according to claim 1, wherein after causing the hydraulic pump to automatically stop, in response to determining that there is an indication that the operation with respect to the operation device will be started, the control device causes the hydraulic pump to be automatically activated.

3. The excavator according to claim 2, wherein after causing the hydraulic pump to automatically stop, in response to determining that there is the indication that the operation with respect to the operation device will be started, the control device causes the hydraulic pump to be automatically activated, and causes a rotation speed of the hydraulic pump to return to a second rotation speed that is lower than a first rotation speed at which work can be started, and subsequently, in response to determining that the operation with respect to the operation device has started, the control device causes the rotation speed of the hydraulic pump to return to the first rotation speed from the second rotation speed.

4. The excavator according to claim 2, wherein the control device determines whether there is the indication that the operation with, respect to the, operation device will be started, based on detection information of a sensor configured to detect a touch with respect to the operation device, an electric signal output from the operation device, or image information of a camera installed in an interior of the cabin of the excavator.

5. The excavator according to claim 1, wherein, even when the operation device is not operated, in response to determining that there is an indication that the operation with respect to the operation device will be started, the control device does not cause the hydraulic pump to automatically stop.

6. The excavator according to claim 1, further comprising:

a reporting unit configured to report at least one of a message that the hydraulic pump cannot be activated and a reason why the hydraulic pump cannot be activated, in response to determining that the seat belt of the operator seat in the excavator is not worn, the window or the door of the cabin of the excavator is not closed, or the opening for maintenance in the excavator is not closed, after the control device causes the hydraulic pump to automatically stop.

7. The excavator according to claim 1, wherein, even when the operation device is not operated, in response to determining that a person is present within a predetermined range around the excavator or that the excavator is in a predetermined unstable state, the control device does not cause the hydraulic pump to be automatically activated.

8. The excavator according to claim 1, wherein, after causing the hydraulic pump to be automatically stopped, in response to determining that a person has entered into a predetermined range around the excavator, the control device causes the hydraulic pump to be automatically activated.

9. The excavator according to claim 1, further comprising:

a high voltage power storage device configured to supply power having a voltage that is greater than or equal to a predetermined threshold to the electric motor, wherein even when the operation device is not operated, in response to determining that a remaining capacity of the high voltage power storage device has become less than or equal to a predetermined threshold, or deterioration of the high voltage power storage device has progressed more than a predetermined threshold, the control device does not cause the hydraulic pump to be automatically stopped.

10. The excavator according to claim 1, further comprising:

a reporting unit configured to report that the excavator is in operation, in response to determining that the hydraulic pump is caused to automatically stop by the control device.

11. The excavator according to claim 1, further comprising:

a surrounding monitoring function configured to monitor a predetermined object around the excavator, wherein even when the hydraulic pump is caused to automatically stop by the control device, the surrounding monitoring function continues to operate.

12. The excavator according to claim 1, further comprising:

an operating unit configured to stop a function of the control device of causing the hydraulic pump to automatically stop when the operation device is not operated.

13. An excavator comprising:

a lower traveling body;

an upper turning body tunably mounted to the lower traveling body;

a work attachment attached to the upper turning body;

an imaging device mounted to the upper turning body;

a hydraulic actuator;

a hydraulic pump configured to supply hydraulic oil to the hydraulic actuator;

an electric motor configured to drive the hydraulic pump;

an operation device of an electric type configured to operate the hydraulic actuator;

a control device configured to control the electric motor;

a power generating unit configured to generate power by power of the electric motor; and a low voltage power storage device configured to be charged with the power generated by the power generating unit, and to supply power to a device that operates at a voltage that is less than or equal to a predetermined threshold including the control device, wherein in response to determining that the operation device is not operated, the control device causes the hydraulic pump to automatically stop, and subsequently, in response to determining that an operation with respect to the operation device is started, the control device causes the hydraulic pump to be automatically activated, and even when the operation device is not operated, in response to determining that a remaining capacity of the low voltage power storage device has become less than or equal to a predetermined threshold, or deterioration of the low voltage power storage device has progressed more than a predetermined threshold, the control device does not cause the hydraulic pump to be automatically stopped.

14. The excavator according to claim 13, further comprising:

a high voltage power storage device configured to supply power having a voltage that is greater than or equal to another predetermined threshold to the electric motor, wherein even when the operation device is not operated, in response to determining that a remaining capacity of the high voltage power storage device has become less than or equal to a first predetermined threshold, or deterioration of the high voltage power storage device has progressed more than a second predetermined threshold, the control device does not cause the hydraulic pump to be automatically stopped.

15. The excavator according to claim 13, further comprising:

a reporting unit configured to report that the excavator is in operation, in response to determining that the hydraulic pump is caused to automatically stop by the control device.

16. The excavator according to claim 13, further comprising:

a surrounding monitoring function configured to monitor a predetermined object around the excavator, wherein even when the hydraulic pump is caused to automatically stop by the control device, the surrounding monitoring, function continues to operate.

17. The excavator according to claim 13, further comprising:

an operating unit configured to stop a function of the control device of causing the hydraulic pump to automatically stop when the operation device is not operated.

18. An excavator comprising:

a lower traveling body;

an upper turning body turnably mounted to the lower traveling body;

a work attachment attached to the upper turning body;

an imaging device mounted to the upper turning body;

a hydraulic actuator;

a hydraulic pump configured to supply hydraulic oil to the hydraulic actuator;

an electric motor configured to drive the hydraulic pump;

an operation device of an electric type configured to operate the hydraulic actuator; and a control device configured to control the electric motor, wherein in response to determining that the operation device is not operated, the control device causes the hydraulic pump to automatically stop, and subsequently, in response to determining that an operation with respect to the operation device is started, the control device causes the hydraulic pump to be automatically activated, and even when the operation device is not operated, in response to determining that a warm-up operation of the excavator is necessary, the control device does not cause the hydraulic pump to be automatically stopped.

19. The excavator according to claim 18, further comprising:

a reporting unit configured to report that the excavator is in operation, in response to determining that the hydraulic pump is caused to automatically stop by the control device.

20. The excavator according to claim 18, further comprising:

a surrounding monitoring function configured to monitor a predetermined object around the excavator, wherein even when the hydraulic pump is caused to automatically stop by the control device, the surrounding monitoring function continues to operate.

* * * * *